US005816374A

United States Patent [19]

Hsien

[11] Patent Number: 5,816,374

[45] Date of Patent: Oct. 6, 1998

[54] LOCK MECHANISM OF A PULL HANDLE ASSEMBLY FOR A WHEELED SUITCASE

[75] Inventor: Kuo Chung Hsien, Taipei County, Taiwan

[73] Assignee: Chaw Khong Technology Co., Ltd., Taipei, Taiwan

[21] Appl. No.: 602,933

[22] Filed: Feb. 16, 1996

[51] Int. Cl.[6] ..... A45C 13/22; A45C 13/26; A45C 5/14

[52] U.S. Cl. ..... 190/115; 190/18 A; 190/39; 16/115

[58] Field of Search ..... 190/18 A, 39, 190/115–117; 16/115

[56] References Cited

U.S. PATENT DOCUMENTS

| | | | |
|---|---|---|---|
| 3,513,952 | 5/1970 | Warner, Jr. | 190/18 A |
| 3,522,955 | 8/1970 | Warner, Jr. | 190/18 A |
| 3,572,870 | 3/1971 | Marks et al. | 190/39 X |
| 4,792,025 | 12/1988 | Thomas | 190/115 X |
| 5,414,895 | 5/1995 | Kazmark, Jr. | 16/115 |
| 5,421,605 | 6/1995 | Chen | 280/655 |
| 5,438,731 | 8/1995 | Kazmark, Jr. | 16/115 |
| 5,447,217 | 9/1995 | Chou | 190/18 A |
| 5,513,873 | 5/1996 | Chen | 16/115 X |
| 5,524,503 | 6/1996 | Ishikura | 16/115 X |
| 5,530,990 | 7/1996 | Chen | 190/39 X |
| 5,613,273 | 3/1997 | Tsai | 16/115 |

*Primary Examiner*—Sue A. Weaver
*Attorney, Agent, or Firm*—Christensen, O'Connor Johnson & Kindness PLLC

[57] ABSTRACT

The present invention relates to a lock mechanism of a pull handle assembly for locking a pull handle of the pull handle assembly. The pull handle assembly of a wheeled suitcase comprises a head set mounted on an upper end of the suitcase, two elongated tubes vertically mounted under the head set, a U-shaped pull handle having a gripping handle and two rod members telescopingly mounted within the two tubes, each of the two rod members comprising a hole installed near the gripping handle, and a lock mechanism installed in the head set comprising two locking members installed between the two rod members for latching the two holes of the rod members and a rotatable switch for releasing the two locking members from the two holes of the rod members, the rotatable switch comprising a chip rotatably fixed between the two locking members, said chip comprising two holes and one chip handle, each of the two locking members comprising a button slidingly engaged in one of the two holes of the chip wherein the two buttons of the two locking members are moved by the two holes of the chip when the chip is rotated by pulling the chip handle.

12 Claims, 4 Drawing Sheets

LOCK MECHANISM OF A PULL HANDLE ASSEMBLY FOR A WHEELED SUITCASE

BACKGROUND OF THE INVENTION

1. Field of the Invention

The present invention relates to a pull handle assembly of a wheeled suitcase, and more particularly, to a lock mechanism of a pull handle assembly for locking a pull handle of the pull handle assembly.

2. Description of the Prior Art

Slidable pull handles are commonly used in wheeled suitcases for pulling such suitcases. The basic construction of a slidable pull handle assembly comprises a plastic head set mounted on an upper end of a suitcase, two elongated tubes vertically mounted under the head set, a U-shaped pull handle having a gripping handle and two rod members telescopingly received within the two tubes, and a lock mechanism for locking the pull handle when it is in a retracted position to prevent it from sliding out of the tubes.

Push-button-type lock mechanisms are commonly seen in the market for locking slidable pull handles. One example of such lock mechanism is disclosed in U.S. Pat. No. 5,438,731. In FIGS. 3 and 4 of this U.S. Patent it discloses a lock mechanism for locking a pull handle which can be released by pushing a push button. One problem of such push button design is that it may easily be triggered when the push button is accidentally touched by hand or hit by other suitcases when the suitcase is shipped with other suitcases by a airline freight department. Any force which is substantially in line with the pushing direction of the push button may trigger the push button to unlock the lock mechanism and cause the pull handle slide out. If the lock mechanism can be unlocked by a rotatable switch instead of a push button, such problem can be solved directly.

In FIGS. 6 and 7 of the above mentioned U.S. Patent, it discloses another lock mechanism which uses a rotatable switch to unlock the lock mechanism. Although this lock mechanism solves the mis-trigger problem mentioned above, its mechanical structure is really a questionable design. After the two linking rods and are pushed outward toward the two outer tubes and by rotating the switch from a starting position, it relies on the two spring-loaded lock buttons and to push the two linking rods and inward so that the switch can be rotated back to its starting position when the pull handle reaches an extended or retracted position. In FIG. 3 the push button uses a spring to push itself back to a starting position, but in FIG. 5 there is no correspondent spring installed. It is very questionable that the two spring-loaded lock buttons and can rotate the switch 51 back to its starting position by themselves. Besides, it is very difficult to install or align the four spring-loaded lock buttons inside the two tubes and. If any of the four buttons is mis-aligned after use, there is no way for an end user to fix it up.

SUMMARY OF THE INVENTION

It is therefore the goal of the present invention to provide a new lock mechanism to solve the above mentioned rotatable switch problem.

Briefly, in a preferred embodiment, the present invention includes a pull handle assembly of a wheeled suitcase comprising:

(1) a head set mounted on an upper end of the suitcase;

(2) two elongated tubes vertically mounted under the head set;

(3) a U-shaped pull handle having a gripping handle and two rod members telescopingly mounted within the two tubes, each of the two rod members comprising a hole installed near the gripping handle; and (4) a lock mechanism installed in the head set comprising two locking members installed between the two rod members for latching the two holes of the rod members and a rotatable switch for releasing the two locking members from the two holes of the rod members, the rotatable switch comprising a chip rotatably fixed between the two locking members, said chip comprising two holes and one chip handle, each of the two locking members comprising a button slidingly engaged in one of the two holes of the chip wherein the two buttons of the two locking members are moved by the two holes of the chip when the chip is rotated by pulling the chip handle.

It is an advantage of the present invention that since the two locking members can be moved inward or outward by rotating the chip handle of the rotatable switch, the mechanical problem of the rotatable switch disclosed in the above mentioned U.S. Patent is directly solved.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
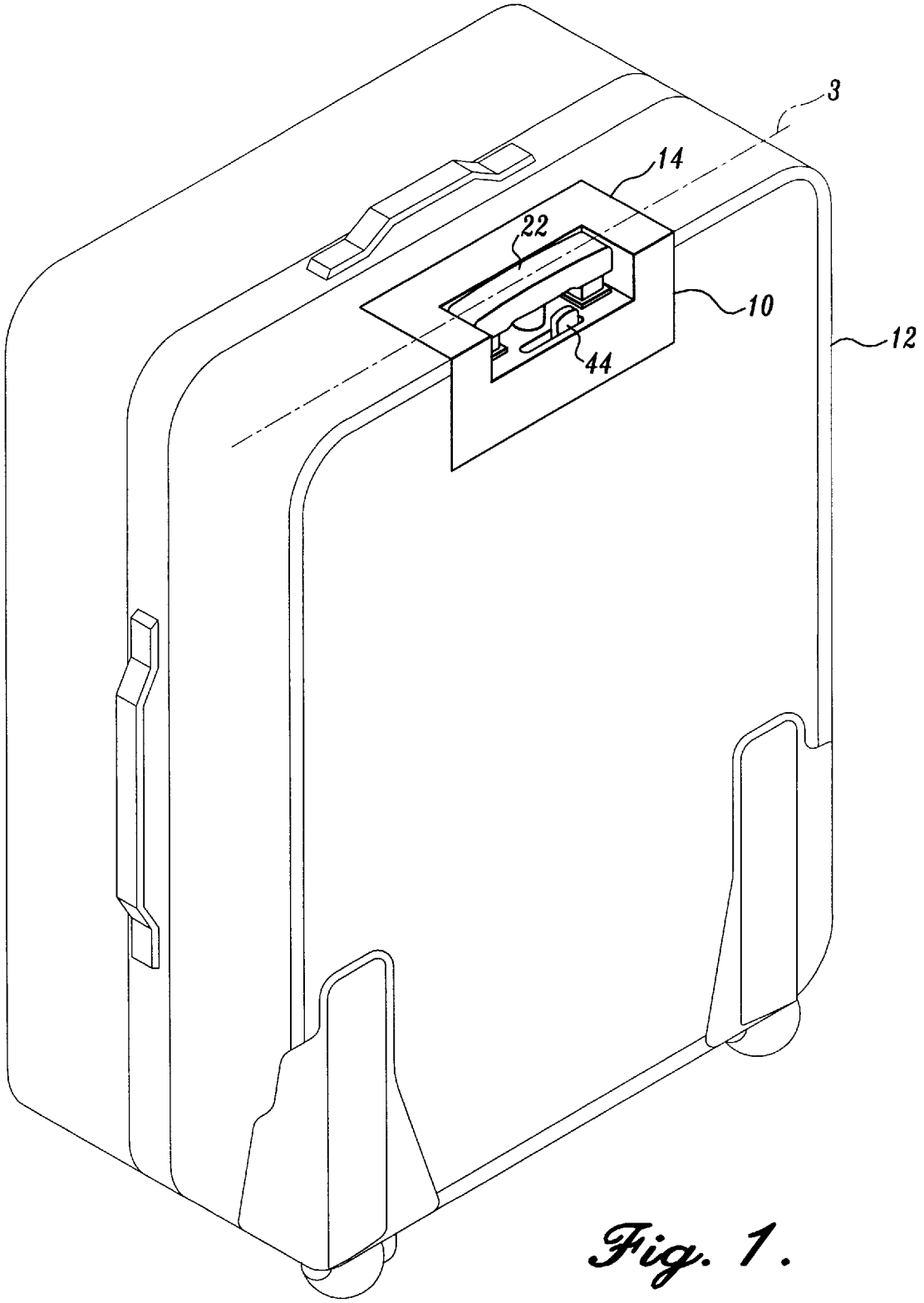
FIG. 1 is a perspective view of a wheeled suitcase equipped with a slidable pull handle assembly according to the present invention.

FIG. 1 is a perspective view of a wheeled suitcase 12 equipped with a slidable pull handle assembly 10 according to the present invention. The pull handle assembly 10 comprises a head set 14 mounted in the upper end of the wheeled suitcase 12 with a groove 26 installed in it, a gripping handle 22 which is pushed into the groove 26 and locked by a lock mechanism (not shown) inside the head set 14 which can be unlocked by pulling a chip handle 44, a spring mechanism 28 installed under the groove 26 for ejecting the gripping handle 22 out of the groove 26 when the lock mechanism is released by pulling the chip handle 44.

Figure 2:
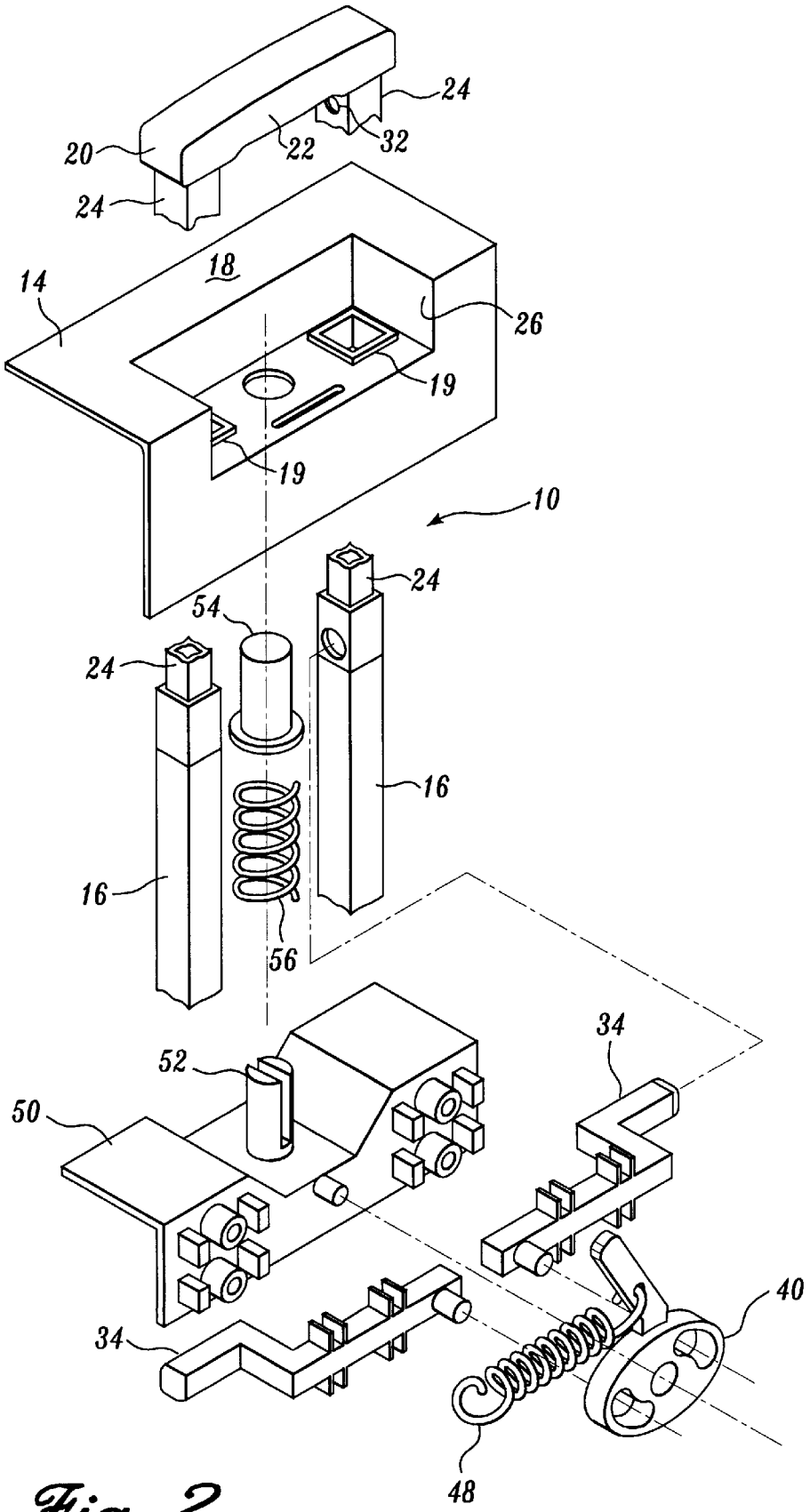
FIG. 2 is an exploded diagram of the pull handle assembly shown in FIG. 1.
Figure 3:
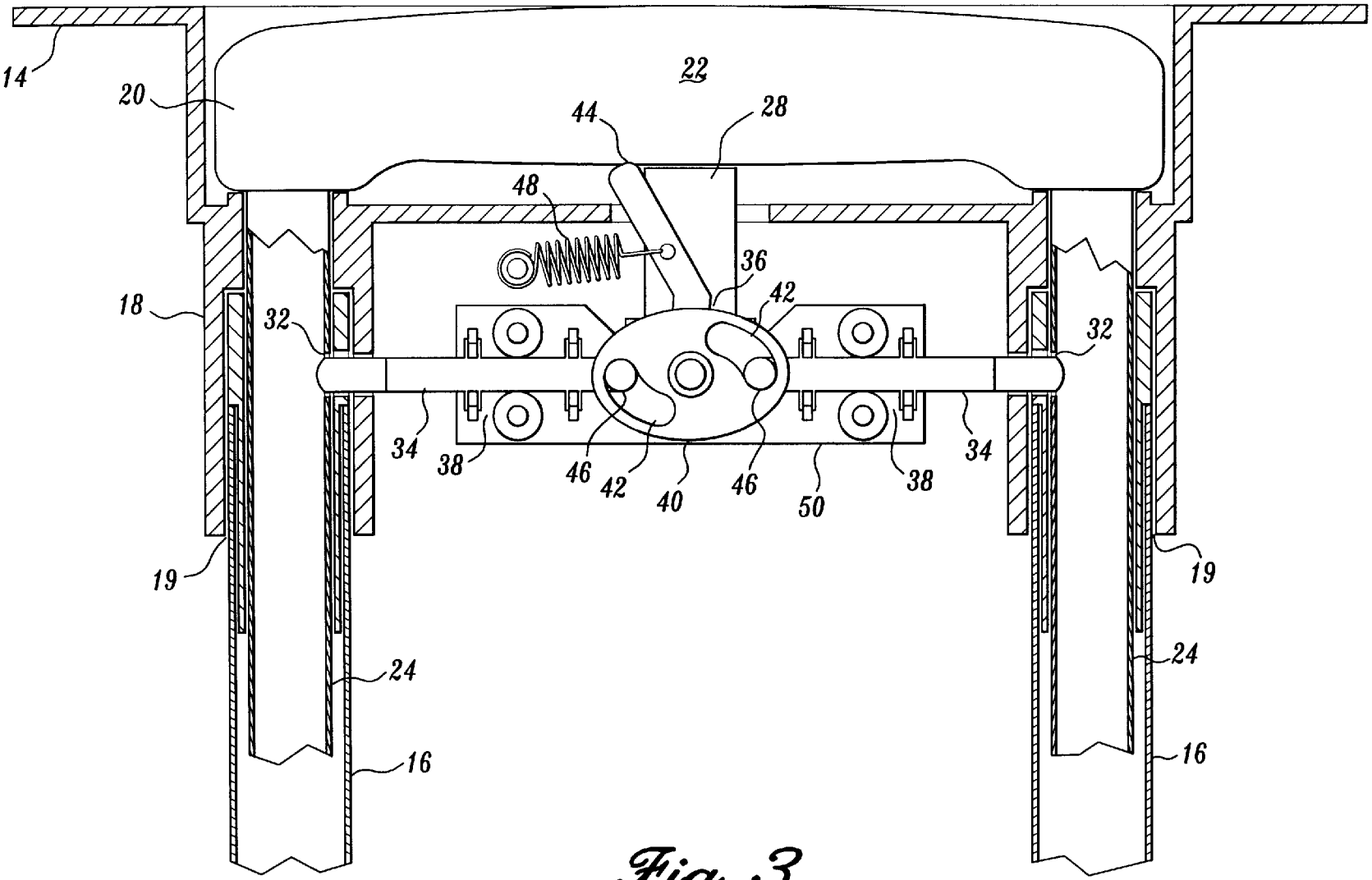
FIG. 3 is a sectional view 3—3 of the wheeled suitcase shown in FIG. 1 which shows the construction of the pull handle assembly.
Figure 4:
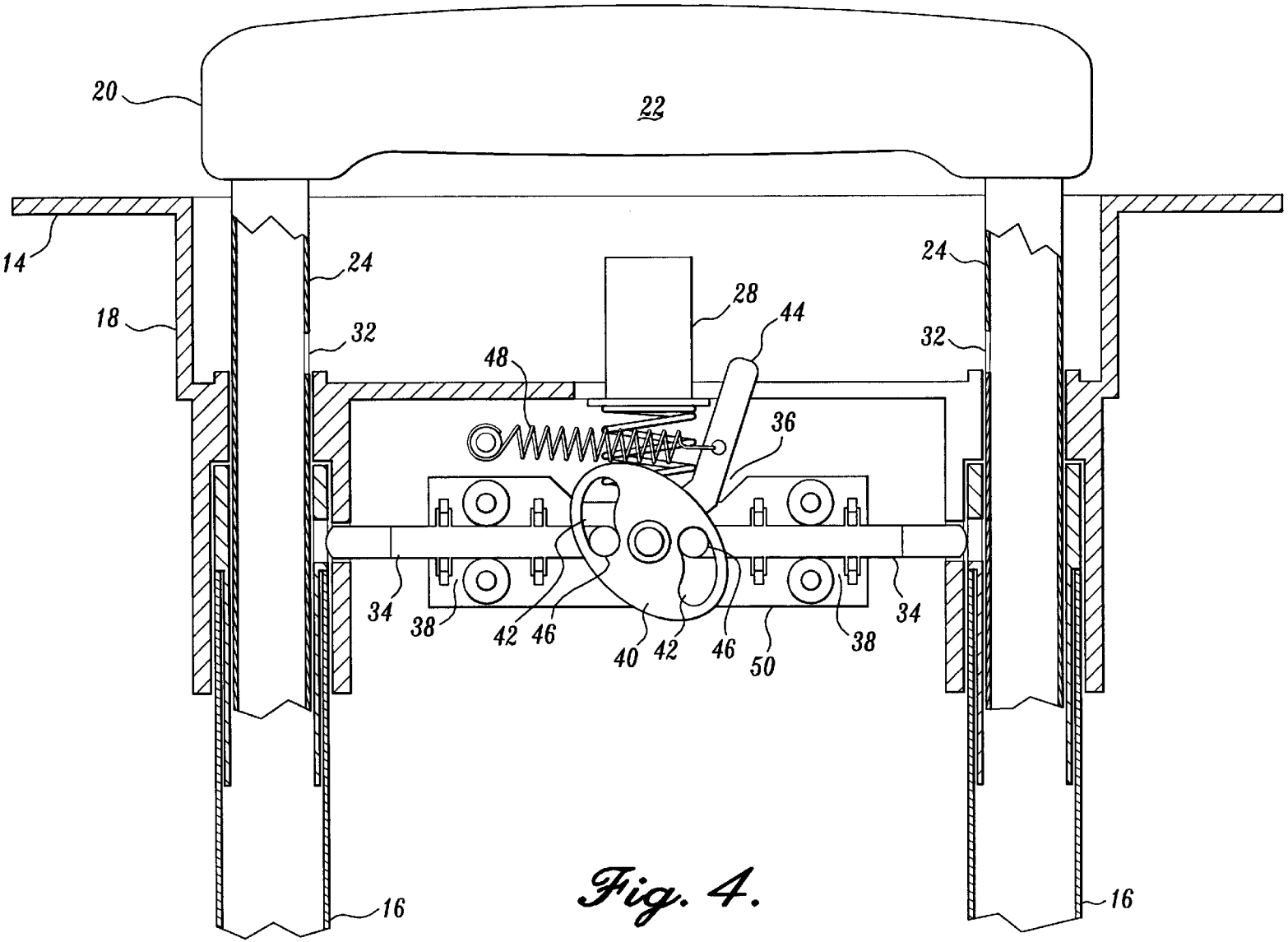
FIG. 4 is the same as FIG. 3 except that the pull handle is unlocked.

FIG. 2 is an exploded diagram of the pull handle assembly 10 shown in FIG. 1, FIG. 3 is a sectional view 3—3 of the wheeled suitcase 12 shown in FIG. 1 which shows the construction of the pull handle assembly 10, and FIG. 4 is the same as FIG. 3 except that the pull handle 20 is unlocked. The pull handle assembly 10 comprises a head set 14 mounted on an upper end of the suitcase 12, having two holes 19 two elongated tubes 16 vertically mounted under the head set within the two holes 19 of the head set 14, a U-shaped pull handle 20 vertically mounted above the head set 14 having a gripping handle 22 and two rod members 24 telescopingly mounted within the two tubes 16, through the two holes 19 of the head set 14 a spring mechanism 28 attached to and installed in the head set 14 vertically disposed under the gripping handle 22 for ejecting the pull handle 20 upward, and a lock mechanism 30 installed in the head set 14 for locking the pull handle 20 to the head set 14 when the gripping handle 22 is pushed into the groove 26 of the head set 14.

The head set 14 comprises two plastic pieces: a head piece 18 and a bottom piece 50 fastened inside the head piece 18. The spring mechanism 28 comprises a housing formed by a plastic stud 52 installed on the bottom piece 50, a plastic cover 54 and a spring 56 installed between the stud 52 and the cover 54. When the gripping handle 22 of the pull handle 20 is pushed down to the head set 14, the spring mechanism 28 will be depressed downward by the gripping handle 22, and then the pull handle 20 will be locked by the lock mechanism 30 to prevent it from ejecting upward.

Each of the two vertical rod members 24 comprises a hole 32 installed near the gripping handle 22 and the lock mechanism 30 of the head set 14 comprises two correspondent bar-shaped, elongate locking members 34 installed between the two rod members 24 for latching the two holes 32 of the rod members 24 and a rotatable switch 36 installed between the two locking members 34 for releasing the two locking members 34 from the two holes 32 of the rod members 34. The lock mechanism 30 of the head set 14 further comprises two positioning mechanisms 38 for keeping the two locking members 34 sliding only in two horizontal directions. FIG. 3 shows that when the pull handle 20 is pushed down to the head set 14, the two locking members 34 are pushed into the two holes 32 of the rod members 24 by the rotatable switch 36 to lock the pull handle 20. FIG. 4 shows that the two locking members 34 are released from the two holes 32 by the rotatable switch 36 so that the pull handle 20 is unlocked and ejected up by the spring mechanism 28.

The rotatable switch 36 comprises a chip 40 rotatably fixed at a horizontal axis orthogonal to a plane defined by the chip and positioned over an axis of the bottom piece 50 between the two locking members 34. The chip 40 comprises two curved sliding holes 42 disposed oppositely about the horizontal axis and one cooperatively attached chip handle 44. Each of the two locking members 34 comprises a button 46, disposed adjacent to the chip and positioned adjacent an end of each of the locking members 34, slidingly engaged in one of the two holes 42. When the chip 40 is rotated by pulling the chip handle 44, the two buttons 46 of the two locking members 34 will be slidingly and rotatably moved by the two holes 42 of the chip 40 either inward toward the chip 40 or outward toward the two rod members 24. The rotatable switch 36 further comprises a spring 48 fastened between the chip handle 44 and the bottom piece 50 for constantly pulling the chip handle 44 to force the two buttons 46 of the two locking members 34 move outward toward the two rod members 16. When the pull handle 20 is pushed down to the head set 14, the two locking members 34 will be pushed into the two holes 32 of the rod members 24 by the spring 48 to lock the pull handle 20. And when the chip handle 44 is pulled against the spring 48, the two holes 42 of the chip 40 will slidably move the two buttons 46 of the two locking members 34 inward toward the chip 40 so that the pull handle 20 can be unlocked and ejected up by the spring mechanism 28.

The design of the chip handle 44 can also prevent accidental or undesired actuation of the lock mechanism 30. The chip handle 44 can be accidentally touched by hand when carrying the wheeled suitcase or by other suitcases after it is delivered to a freight shipping department of an airline. If the lock mechanism 30 is accidentally unlocked by a accidental or undesired actuation, the pull handle 20 may get damaged after ejected out of the head set 14. Direct hit from upright direction can not move the chip handle 44 because it can only be moved by horizontal pulling action to rotate the chip 40. Accidental or undesired actuation caused by directly touching or hitting the chip handle 44 can thus be avoided by such design.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A pull handle assembly of a suitcase comprising:

(a) a head set mounted on an upper end of the suitcase, the head set having two holes;

(b) two elongate tubes vertically mounted in the holes of the head set;

(c) a handle mounted on the head set, the handle having a gripping handle and two rod members telescopingly mounted within the tubes, the gripping handle attached to the ends of the rod members, each of the rod members having a hole; and (d) a lock mechanism attached to the head set, the lock mechanism including:

(i) two elongate locking members installed between the rod members, each of the locking members including a button, a first end, and a second end, the button rigidly attached to the locking member at the first end, the second end releasably engageable with one of the holes of the rod members; and (ii) a rotatable switch including a chip rotatable about an axis orthogonal to a plane defined by the rod members, the chip including two slots disposed oppositely about the axis, each of the slots slidably engaged with one of the buttons so that when the chip is rotated the buttons slide in the slots thereby directing the second ends toward the axis.

2. The pull handle assembly of claim 1 further comprising a chip handle attached to the chip.

3. The pull handle assembly of claim 2 further comprising a spring attached between the head set and the chip handle, the spring biasing the chip handle to rotate the chip so that the second ends are directed away from the axis.

4. The pull handle assembly of claim 1 wherein the gripping handle is locked when the second ends engage the holes of the rod members.

5. The pull handle assembly of claim 1 wherein the locking members are orthogonal to the rod members.

6. The pull handle assembly of claim 1 further comprising a spring mechanism attached to the head set and positioned below the gripping handle, the spring mechanism biasing the gripping handle away from the tubes upon contact between the gripping handle and the spring mechanism.

7. The pull handle assembly of claim 1 wherein the head set includes a groove, the gripping handle positioned in the groove when the second ends are engaged with the holes of the rod members.

8. The pull handle assembly of claim 1 wherein the chip is elliptical.

9. A pull handle assembly of a suitcase comprising:

(a) a head set mounted on an upper end of the suitcase, the head set having two holes;

(b) two elongate tubes vertically mounted in the holes of the head set;

(c) a handle mounted on the head set, the handle having a gripping handle and two rod members telescopingly mounted within the tubes, the gripping handle attached to the ends of the rod members, each of the rod members having a hole;

(d) a lock mechanism attached to the head set, the lock mechanism including:

(i) two elongate locking members installed between the rod members, each of the locking members including a first end and a second end, the second end releasably engageable with one of the holes of the rod members; and (ii) a rotatable switch including a chip movably attached to the first ends, the chip rotatable about an axis orthogonal to a plane defined by the rod members so that when the chip is rotated the second ends are directed toward the axis; and (e) a chip handle attached to the chip.

10. The pull handle assembly of claim 9 further comprising a spring attached between the head set and the chip handle, the spring biasing the chip handle to rotate the chip so that the second ends are directed away from the axis.

11. The pull handle assembly of claim 10 wherein the gripping handle is locked when the second ends engage the holes of the rod members.

12. The pull handle assembly of claim 9 further comprising a spring mechanism attached to the head set and positioned adjacent the gripping handle, the spring mechanism biasing the gripping handle away from the tubes upon contact between the gripping handle and the spring mechanism.

* * * * *